US010246214B1

(12) United States Patent
Zhou et al.

(10) Patent No.: US 10,246,214 B1
(45) Date of Patent: Apr. 2, 2019

(54) PACKAGE BOX AND FOLDABLE SHEET MATERIAL

(71) Applicant: Wistron Corporation, New Taipei (TW)

(72) Inventors: Loon Zhou, New Taipei (TW); Zhangying Zhao, New Taipei (TW); Eva Wei, New Taipei (TW)

(73) Assignee: Wistron Corporation, New Taipei (TW)

( * ) Notice: Subject to any disclaimer, the term of this patent is extended or adjusted under 35 U.S.C. 154(b) by 0 days.

(21) Appl. No.: 15/826,601

(22) Filed: Nov. 29, 2017

(30) Foreign Application Priority Data

Oct. 19, 2017 (CN) ..... 2017 1 0979798

(51) Int. Cl.
*B65D 5/02* (2006.01)
*B65D 5/66* (2006.01)
*B65D 5/468* (2006.01)

(52) U.S. Cl.
CPC ..... *B65D 5/0254* (2013.01); *B65D 5/4608* (2013.01); *B65D 5/6602* (2013.01)

(58) Field of Classification Search
CPC ..... B65D 5/02; B65D 5/0254; B65D 5/4608; B65D 5/6602; B65D 5/6608
See application file for complete search history.

(56) References Cited

U.S. PATENT DOCUMENTS 919,292 A * 4/1909 McIndoe ..... B65D 5/0254 229/152
2,279,233 A * 4/1942 Groves ..... B65D 5/0254 229/125.39
4,265,391 A * 5/1981 Zornes ..... B65D 5/0035 206/509
5,181,651 A * 1/1993 Oppenheim ..... B65D 5/0254 229/120
5,263,612 A * 11/1993 Nederveld ..... B65D 5/008 229/112
6,234,385 B1 * 5/2001 Espinoza ..... B65D 5/2038 229/122
2006/0124708 A1 * 6/2006 Lo Duca ..... B65D 5/0254 229/102

(Continued)

FOREIGN PATENT DOCUMENTS

CN 204433242 U 7/2015
CN 204568196 U 8/2015

(Continued)

*Primary Examiner* — Corey N Skurdal
(74) *Attorney, Agent, or Firm* — Winston Hsu

(57) ABSTRACT

A package box includes two top plate portions at its top side, which are superimposed on each other and detachably fixed with each other through an engagement structure. The package box includes two right side plate portions at its right side, which are superimposed on each other and detachably fixed with each other through an engagement structure. The package box includes two left side plate portions at its left side, which are superimposed on each other and detachably fixed with each other through an engagement structure. The package box can be opened from the top side, the right side, or the left side after the corresponding engagement structure is opened. The package box can be formed by folding a foldable sheet material.

18 Claims, 9 Drawing Sheets

(56) References Cited

U.S. PATENT DOCUMENTS

| | | | | |
|---|---|---|---|---|
| 2008/0237320 | A1* | 10/2008 | Philips | B65D 5/28 229/109 |
| 2008/0237325 | A1* | 10/2008 | Mittelstaedt | B65D 5/22 229/117.17 |
| 2009/0057387 | A1* | 3/2009 | Tirado Alanis | B65D 5/2057 229/145 |
| 2010/0051678 | A1* | 3/2010 | Anderson | B65D 5/0254 229/162.1 |
| 2014/0166733 | A1* | 6/2014 | Zhou | B65D 5/0254 229/100 |

FOREIGN PATENT DOCUMENTS

| | | | |
|---|---|---|---|
| JP | 2009-220842 | A | 10/2009 |
| TW | 344364 | | 11/1998 |

* cited by examiner

PACKAGE BOX AND FOLDABLE SHEET MATERIAL

BACKGROUND OF THE INVENTION

1. Field of the Invention

The invention relates to a package box, and especially relates to a package box which can be opened from multiple sides thereof, and a foldable sheet material for being folded to form the package box.

2. Description of the Prior Art

Conventional cartons usually offer only one open side (e.g. the carton is capable of being opened from its top side) or two opposite open sides (e.g. the carton is capable of being opened from its top and bottom sides) for users to take out an object from the carton or put an object in the carton. However, sometimes it may be inconvenient for users to take an object from the carton in some cases, for example, that the object is too heavy or the carton is too high. If the object is taken out by damage the carton, the object may also be damaged during the taking-out process. Furthermore, if a carton is designed specially for each object, the use scope of the carton is limited.

SUMMARY OF THE INVENTION

An aspect of the invention is to provide a package box which can be opened from the top side, the right side, or the left side thereof for user's convenience of taking out an object inside the package box.

The package box according to the invention includes a bottom plate portion, a front plate portion, a rear plate portion, a first top plate portion, a second top plate portion, a first right side plate portion, a second right side plate portion, a first left side plate portion, a second left side plate portion, a right bottom plate portion, a right top plate portion, a left bottom plate portion, and a left top plate portion. The front plate portion is connected to the bottom plate portion. The rear plate portion is connected to the bottom plate portion opposite to the front plate portion. The first top plate portion is connected to the front plate portion opposite to the bottom plate portion. The second top plate portion is connected to the rear plate portion opposite to the bottom plate portion. The first top plate portion and the second top plate portion are superimposed on each other and detachably fixed with each other through a top engagement structure. The first right side plate portion is connected to the front plate portion. The second right side plate portion is connected to the rear plate portion corresponding to the first right side plate portion. The first right side plate portion and the second right side plate portion are superimposed on each other and detachably fixed with each other through a right engagement structure. The first left side plate portion is connected to the front plate portion opposite to the first right side plate portion. The second left side plate portion is connected to the rear plate portion corresponding to the first left side plate portion and opposite to the second right side plate portion. The first left side plate portion and the second left side plate portion are superimpose on each other and detachably fixed with each other through a left engagement structure. The right bottom plate portion is connected to the first right side plate portion or the second right side plate portion and superimposed on the bottom plate portion. The right top plate portion is connected to the first right side plate portion or the second right side plate portion opposite to the right bottom plate portion. The first top plate portion and the second top plate portion are superimposed on the right top plate portion. The left bottom plate portion is connected to the first left side plate portion or the second left side plate portion and superimposed on the bottom plate portion. The left top plate portion is connected to the first left side plate portion or the second left side plate portion opposite to the left bottom plate portion. The first top plate portion and the second top plate portion are superimposed on the left top plate portion. Thereby, a user can open the package box from the top side, the right side, or the left side thereof by opening the top engagement structure, the right engagement structure, and the left engagement structure.

Another aspect of the invention is to provide a foldable sheet material capable of being folded to form a package box. The package box can be opened from the top side, the right side, or the left side thereof for user's convenience of taking out an object inside the package box.

The foldable sheet material box according to the invention includes a bottom plate portion, a front plate portion, a rear plate portion, a first top plate portion, a second top plate portion, a first right side plate portion, a second right side plate portion, a first left side plate portion, a second left side plate portion, a right bottom plate portion, a right top plate portion, a left bottom plate portion, and a left top plate portion. Therein, the front plate portion extends from an edge of the bottom plate portion. The rear plate portion extends from another edge of the bottom plate portion opposite to the front plate portion. The first top plate portion extends from an edge of the front plate portion opposite to the bottom plate portion. The second top plate portion extends from an edge of the rear plate portion opposite to the bottom plate portion. The first right side plate portion extends from another edge of the front plate portion. The second right side plate portion extends from another edge of the rear plate portion corresponding to the first right side plate portion. The first left side plate portion extends from another edge of the front plate portion opposite to the first right side plate portion. The second left side plate portion extends from another edge of the rear plate portion corresponding to the first left side plate portion and opposite to the second right side plate portion. The right bottom plate portion extends from an edge of the first right side plate portion or an edge of the second right side plate portion and is located between the first right side plate portion and the second right side plate portion. The right top plate portion extends from another edge of the first right side plate portion or another edge of the second right side plate portion opposite to the right bottom plate portion. The left bottom plate portion extends from an edge of the first left side plate portion or an edge of the second left side plate portion and is located between the first left side plate portion and the second left side plate portion. The left top plate portion extends from another edge of the first left side plate portion or another edge of the second left side plate portion opposite to the left bottom plate portion. In practice, the foldable sheet material can be provided with creasing lines among the above plate portions for convenience of folding. A user can fold the foldable sheet material to form a package box. The user can open the package box from the top side, the right side, or the left side thereof.

Compared with the prior art, the package box according to the invention offers three open sides to users. The user can open the package box from the top side, the right side, or the left side thereof on demand. Therefore, the package box according to the invention has flexibility of use and can effectively solve the problem that it may be inconvenient for users to take an object from a conventional carton in some practical cases because of the limited open sides of the conventional carton.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
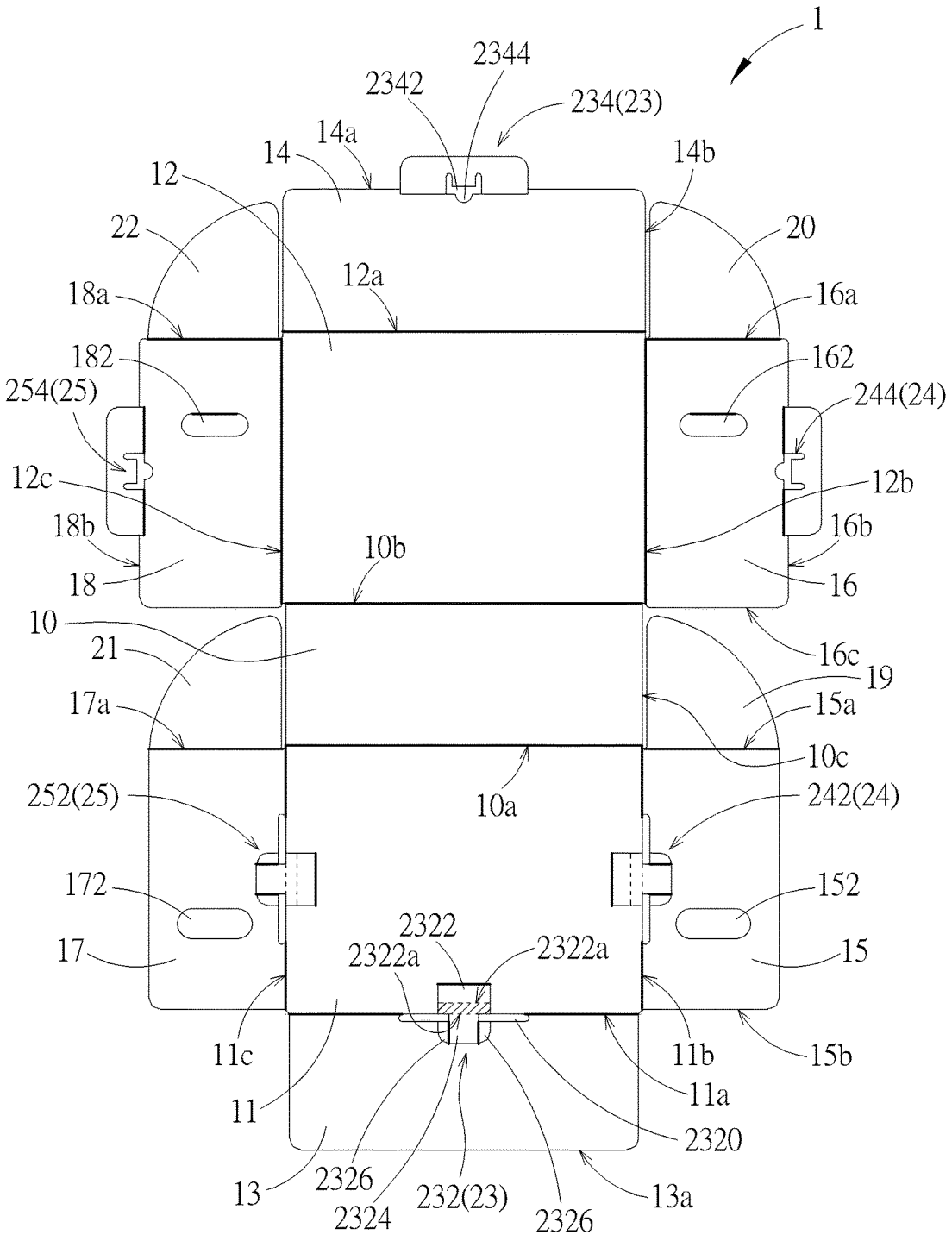
FIG. 1 is a schematic diagram illustrating a foldable sheet material of an embodiment used for being folded to form a package box.

Please refer to FIG. 1 to FIG. 5. A foldable sheet material 1 (as shown by FIG. 1) of an embodiment can be made of paper (e.g. corrugated fiberboard), plastic (e.g. polypropylene), or other materials (including composite materials) suitable capable of being formed into a plate capable of being bent or folded. The foldable sheet material 1 includes a bottom plate portion 10, a front plate portion 11, a rear plate portion 12, a first top plate portion 13, a second top plate portion 14, a first right side plate portion 15, a second right side plate portion 16, a first left side plate portion 17, a second left side plate portion 18, a right bottom plate portion 19, a right top plate portion 20, a left bottom plate portion 21, and a left top plate portion 22. Therein, the front plate portion 11 extends from an edge 10*a* of the bottom plate portion 10. The rear plate portion 12 extends from another edge 10*b* of the bottom plate portion 10 opposite to the front plate portion 11. The first top plate portion 13 extends from an edge 11*a* of the front plate portion 11 opposite to the bottom plate portion 10. The second top plate portion 14 extends from an edge 12*a* of the rear plate portion 12 opposite to the bottom plate portion 10. The first right side plate portion 15 extends from another edge 11*b* of the front plate portion 11. The second right side plate portion 16 extends from another edge 12*b* of the rear plate portion 12 corresponding to the first right side plate portion 15. The first left side plate portion 17 extends from another edge 11*c* of the front plate portion 11 opposite to the first right side plate portion 15. The second left side plate portion 18 extends from another edge 12*c* of the rear plate portion 12 corresponding to the first left side plate portion 17 and opposite to the second right side plate portion 16. The right bottom plate portion 19 extends from an edge 15*a* of the first right side plate portion 15 and is located between the first right side plate portion 15 and the second right side plate portion 16. The right top plate portion 20 extends from an edge 16*a* of the second right side plate portion 16 opposite to the right bottom plate portion 19. The left bottom plate portion 21 extends from an edge 17*a* of the first left side plate portion 17 and is located between the first left side plate portion 17 and the second left side plate portion 18. The left top plate portion 22 extends from an edge 18*a* of the second left side plate portion 18 opposite to the left bottom plate portion 21. For the convenience of folding the foldable sheet material 1, creasing lines (shown in bold lines in FIG. 1, in which cutting lines and profile lines of the foldable sheet material 1 are shown in thin lines) are formed, for example by use of a creasing tool, at the places where the above plate portions are connected.

Figure 2:
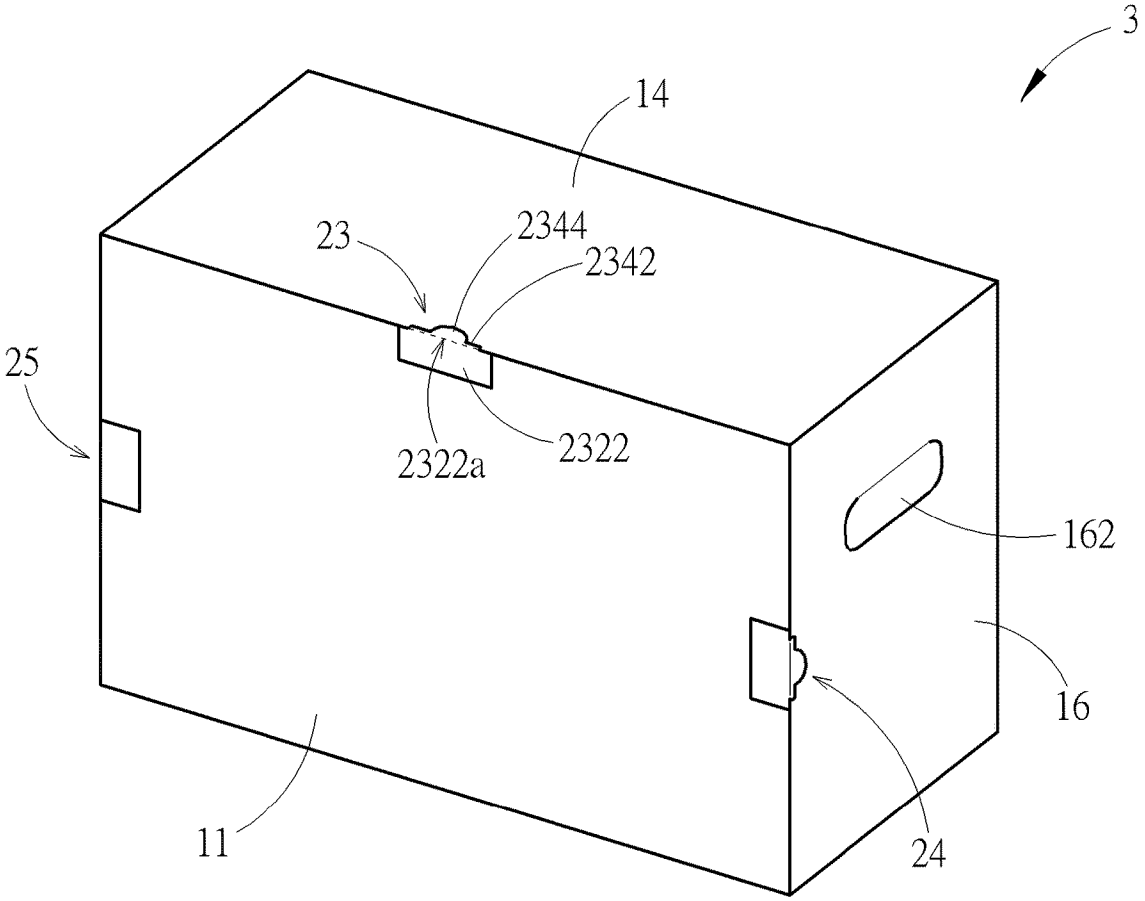
FIG. 2 is a schematic diagram illustrating the package box formed by folding the foldable sheet material in FIG. 1.
Figure 3:
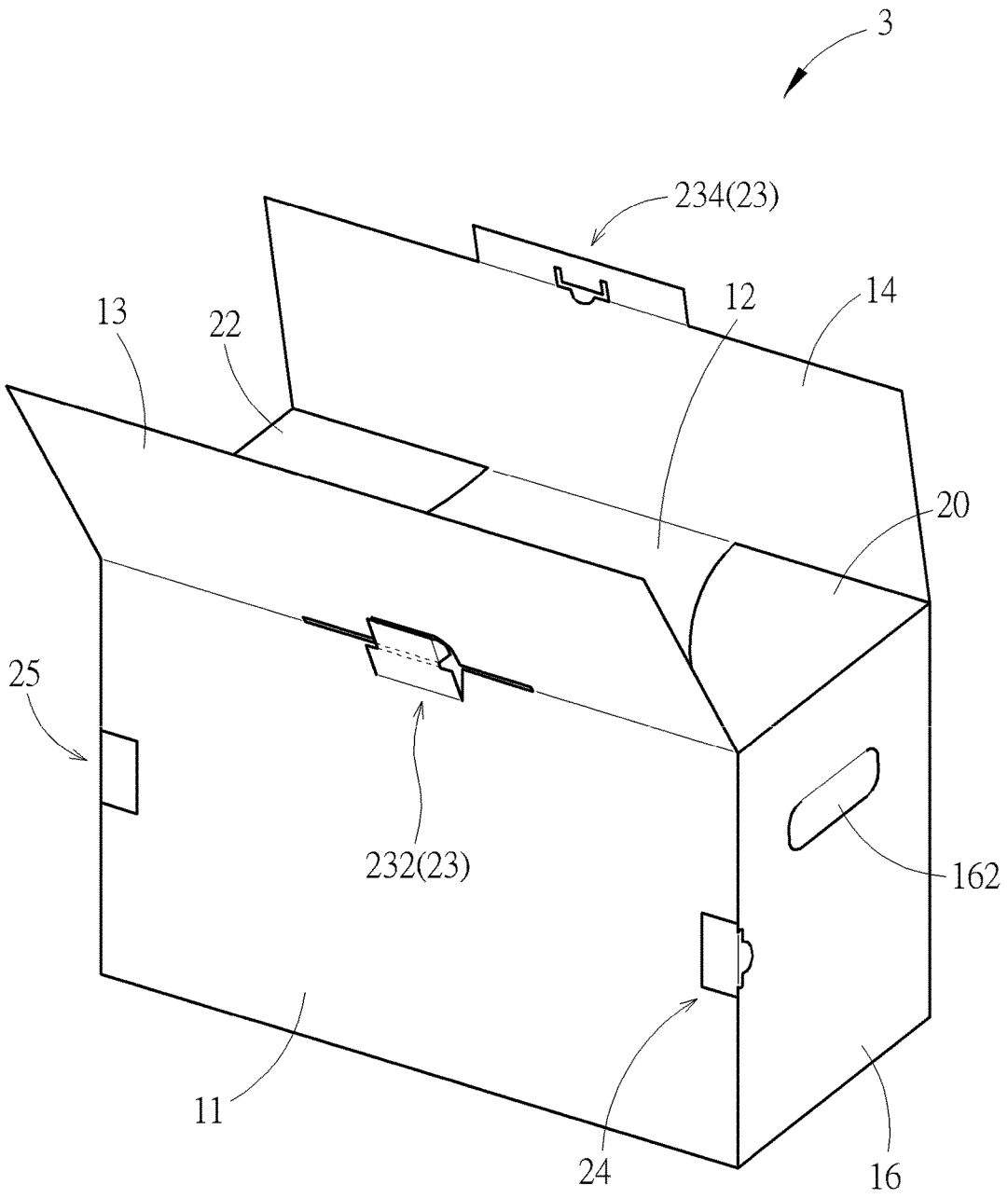
FIG. 3 is a schematic diagram illustrating the package box in FIG. 2 that is opened from its top side.
Figure 4:
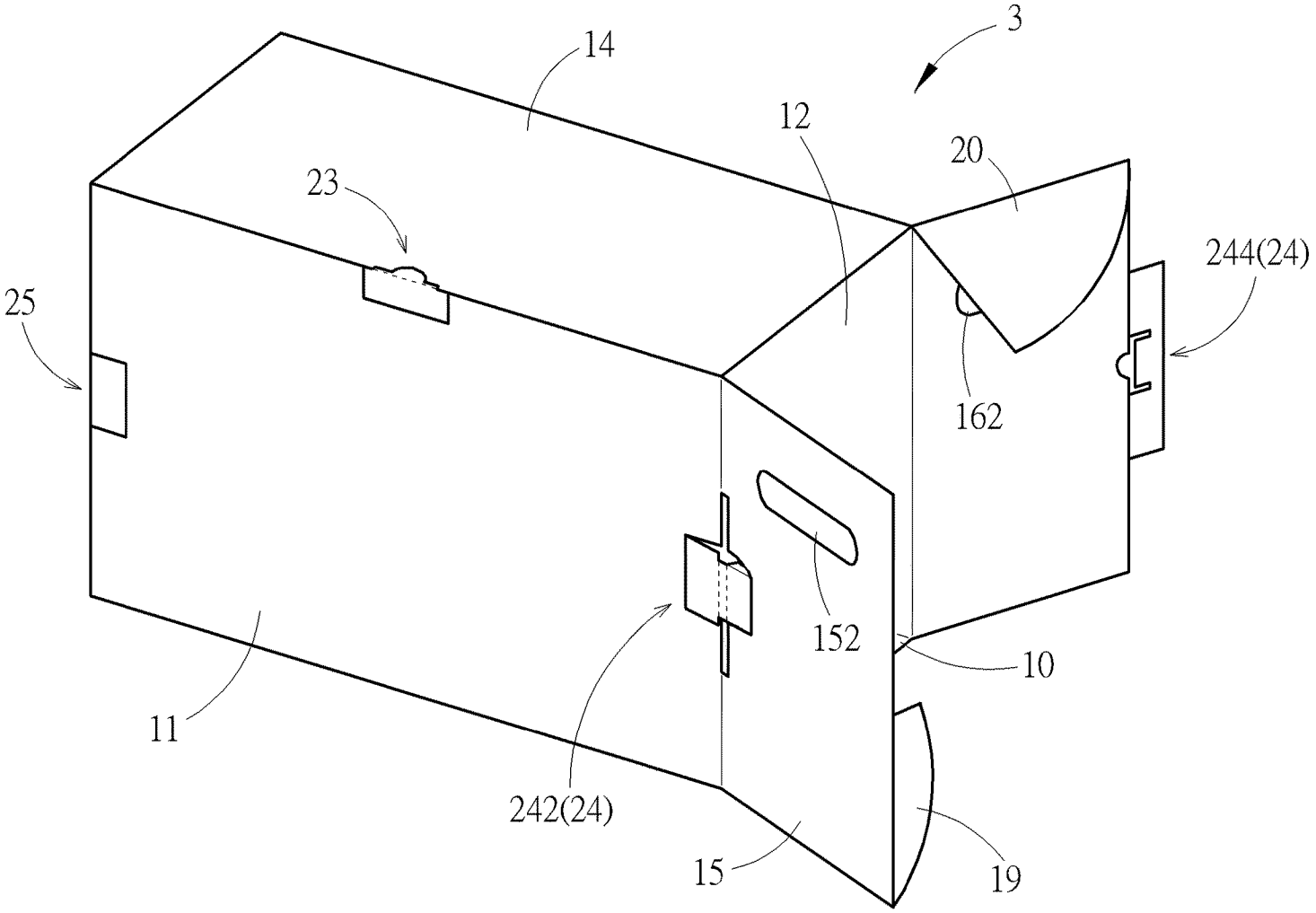
FIG. 4 is a schematic diagram illustrating the package box in FIG. 2 that is opened from its right side.
Figure 5:
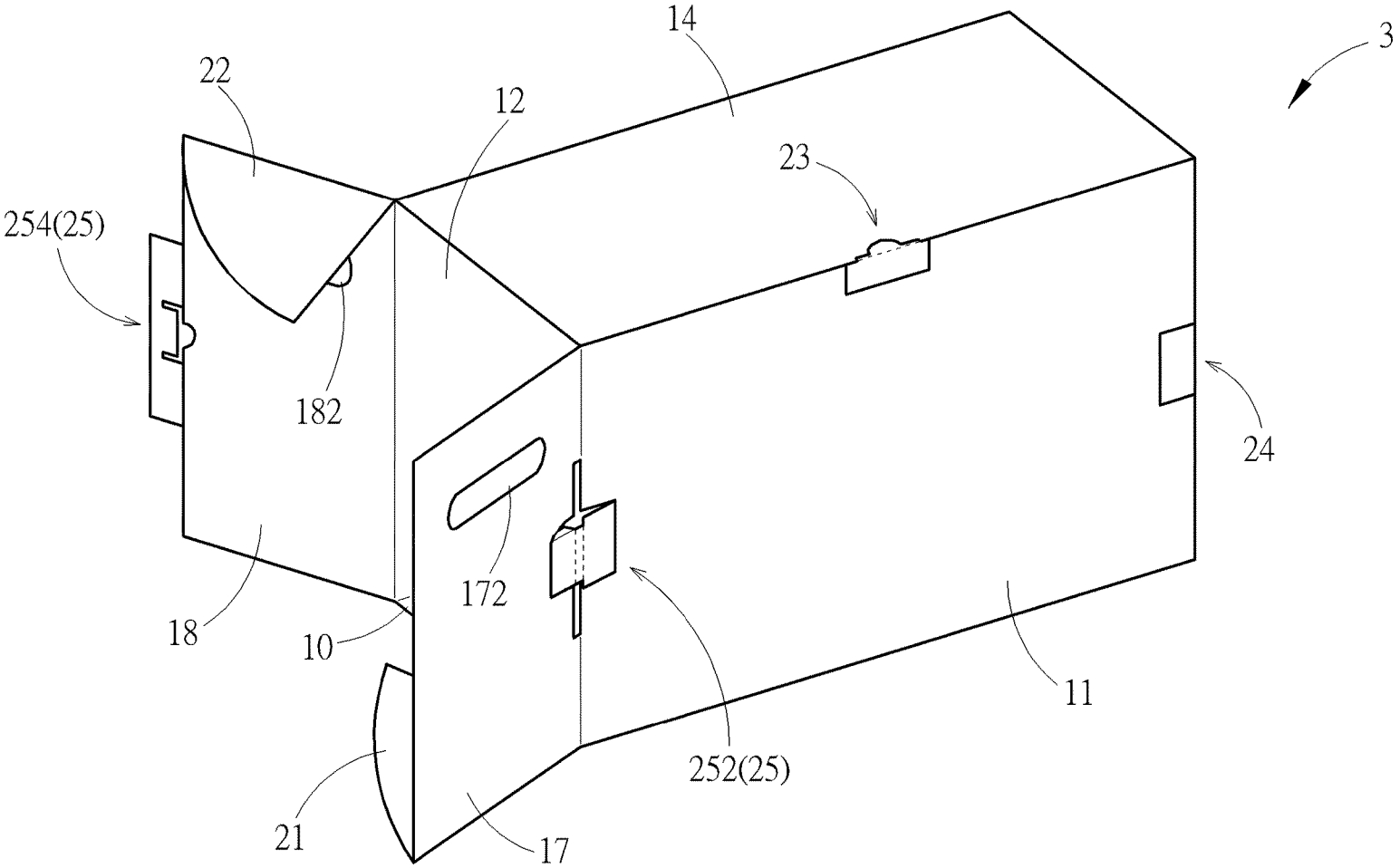
FIG. 5 is a schematic diagram illustrating the package box in FIG. 2 that is opened from its left side.

The foldable sheet material 1 can be folded into a package box 3 (as shown by FIG. 2). In other words, the foldable sheet material 1 is an expanded view of the package box 3. Therein, the first top plate portion 13 and the second top plate portion 14 are superimposed on each other so as to close the top side of the package box 3. The first right side plate portion 15 and the second right side plate portion 16 are superimposed on each other so as to close the right side of the package box 3. The first left side plate portion 17 and the second left side plate portion 18 are superimposed on each other so as to close the left side of the package box 3. The right bottom plate portion 19 and the left bottom plate portion 21 are superimposed on the bottom plate portion 10 (inside the package box 3). The first top plate portion 13 and the second top plate portion 14 are superimposed on the right top plate portion 20 and the left bottom plate portion 21 (inside the package box 3). In the embodiment, the first top plate portion 13 and the second top plate portion 14 are detachably fixed with each other through a top engagement structure 23. The first right side plate portion 15 and the second right side plate portion 16 are detachably fixed with each other through a right engagement structure 24. The first left side plate portion 17 and the second left side plate portion 18 are detachably fixed with each other through a left engagement structure 25. Thereby, a user can open the package box 3 from the top side, the right side, or the left side thereof on demand by opening the top engagement structure 23, the right engagement structure 24, or the left engagement structure 25 respectively (referring to FIG. 3 to FIG. 5).

Figure 6:
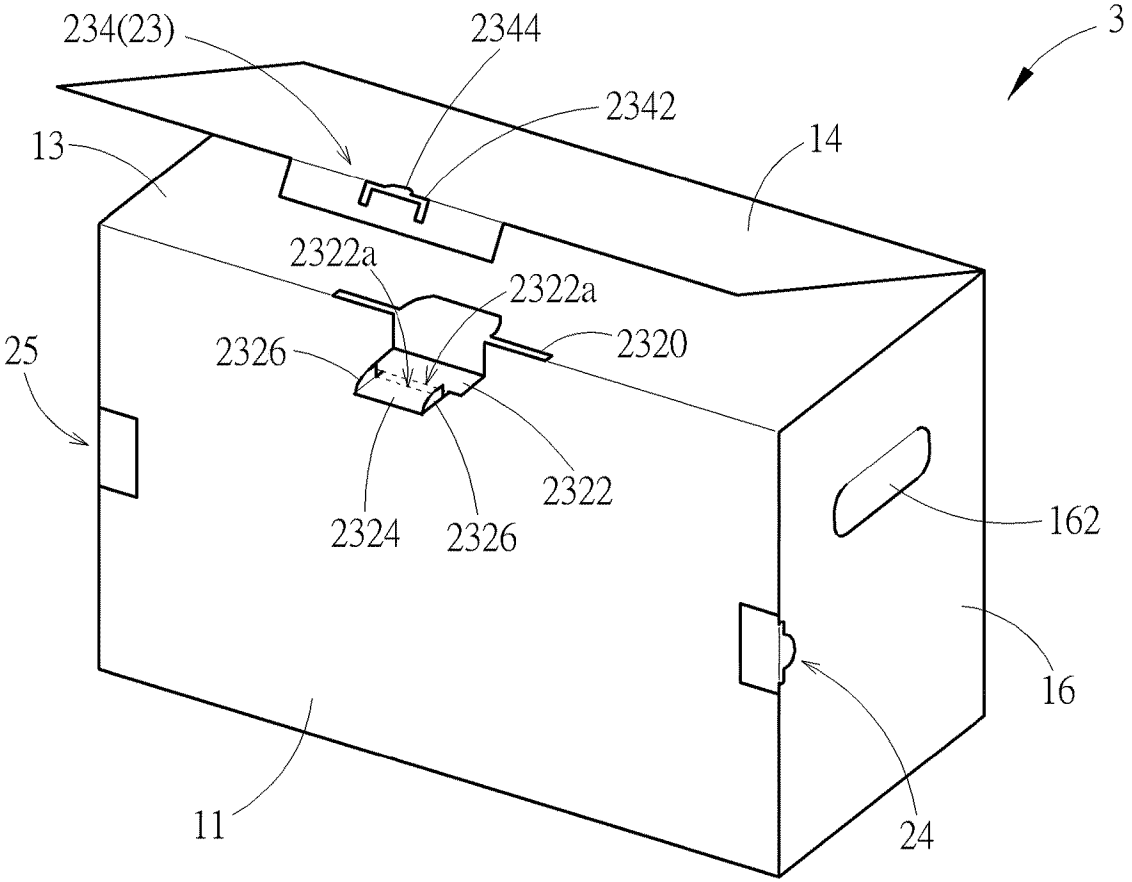
FIG. 6 is a schematic diagram illustrating a top engagement structure of the package box in FIG. 2 for fixing a first top plate portion with a second top plate portion of the package box.

In the embodiment, the top engagement structure 23 includes an engaging tab 232 and a slot structure 234. The engaging tab 232 is disposed at the place where the first top plate portion 13 the front plate portion 11 are connected. The engaging tab 232 includes a connection portion 2322, an insertion portion 2324, and two wing portions 2326. The engaging tab 232 is connected through the connection portion 2322 to the place where the front plate portion 11 and the first top plate portion 13 are connected. The insertion portion 2324 is connected to the connection portion 2322. The two wing portions 2326 are connected to two opposite sides of the insertion portion 2324 respectively. The slot structure 234 is disposed at an edge 14*a* of the second top plate portion 14. The slot structure 234 has an n-shaped slot 2342. The two wing portions 2326 are capable of bending relative to the insertion portion 2324 so that the insertion portion 2324 and the two wing portions 2326 are capable of passing through the n-shaped slot 2342. Please also refer to FIG. 6. In a process of fixing the first top plate portion 13 with the second top plate portion 14 by the top engagement structure 23, the first top plate portion 13 is closed and the engaging tab 232 is pulled out. Then, the second top plate portion 14 is superimposed on the first top plate portion 13 and then the slot structure 234 is inserted into the opening slot 2320. The n-shaped slot 2342 is exposed out of the front plate portion 11 at the moment. An opening hole 2344 that is connected to the n-shaped slot 2342 is exposed out of the second top plate portion 14 for a user to lift the second top plate portion 14 with his finger. Afterward, the two wing portions 2326 are bent relatively so that the two wing portions 2326 and the insertion portion 2324 form an n-shaped structure which can pass through the n-shaped slot 2342. In the embodiment, although the two wing portions 2326 are bent relative to the insertion portion 2324, the two wing portions 2326 still have resilience in a certain degree relative to the insertion portion 2324 in principle; that is, the two wing portions 2326 can produce some resilient effect. Thereby, after the two wing portions 2326 pass through the n-shaped slot 2342, the two wing portions 2326 will spring back so that the two wing portions 2326 cannot be pulled out from the n-shaped slot 2342 in principle. At the moment, the top engagement structure 23 performs the fixing of the first top plate portion 13 with the second top plate portion 14 (as shown by FIG. 2); therein, the second top plate portion 14 is located at the outer side of the first top plate portion 13.

Figure 7:
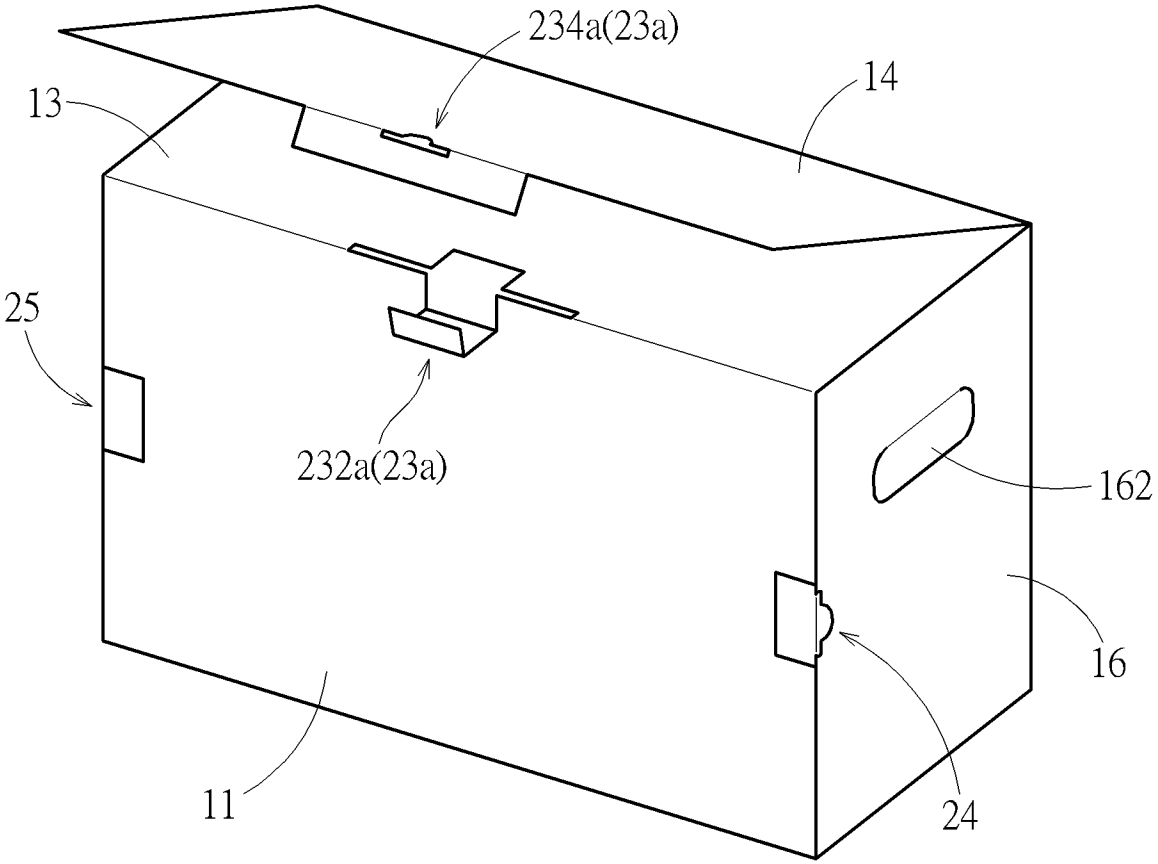
FIG. 7 is a schematic diagram illustrating a top engagement structure of another embodiment for fixing the first top plate portion with the second top plate portion of the package box.

Furthermore, because the bent wing portions 2326 have the capability of springing back, the top engagement structure 23 has a disassembly-prevention function or the top engagement structure 23 cannot be opened without structural damage. In other words, it is practicable to confirm whether the package box 3 was opened from the top side or not by inspecting the top engagement structure 23 for damage. In the embodiment, for the convenience of opening the top engagement structure 23, the connection portion 2322 has two parallel tear lines 2322*a*, e.g. formed by a creasing tool. The two parallel tear lines 2322*a* extend to two opposite edges of the connection portion 2322. After the engaging tab 232 is engaged with the slot structure 234, if a user needs to open the top engagement structure 23, the user can use the tear lines 2322*a* (e.g. by tearing off the hatched portion in FIG. 1) to separate the insertion portion 2324 from the connection portion 2322, so that the first top plate portion 13 and the second top plate portion 14 can be opened again (similar to that shown by FIG. 3). Then the user can take an object inside the package box 3 from the top side of the package box 3. In addition, in practice, the engaging tab 232 can be changed to be disposed at the place where the second top plate portion 14 and the rear plate portion 12 are connected while the slot structure 234 is disposed at an edge 13*a* of the first top plate portion 13. In this case, the first top plate portion 13 and the second top plate portion 14 also can be fixed by engaging the engaging tab 232 with the slot structure 234. Therein, the first top plate portion 13 is located at the outer side of the second top plate portion 14. In addition, in practice, the top engagement structure 23 also can be realized by a reusable structure, e.g. a top engagement structure 23*a* shown in FIG. 7. The top engagement structure 23*a* includes an engaging tab 232*a* and a slot structure 234*a*. The engaging tab 232*a* is not provided with any wing structure like the wing portion 2326. The engaging tab 232*a* and the slot structure 234*a* can be engaged with each other repeatedly.

In the embodiment, the right engagement structure 24 includes an engaging tab 242 and a slot structure 244. The engaging tab 242 is disposed at the place where the front plate portion 11 and the first right side plate portion 15 are connected. The slot structure 244 is disposed at an edge 16*b* of the second right side plate portion 16. When the first right side plate portion 15 and the second right side plate portion 16 are fixed with each other through the right engagement structure 24, the second right side plate portion 16 is located at the outer side of the first right side plate portion 15. In the embodiment, the right engagement structure 24 and the top engagement structure 23 are provided in the same structure. Therefore, for other descriptions of the right engagement structure 24, please refer to the relevant descriptions of the top engagement structure 23 and the variants thereof, which will not be described in addition. Similarly, after the right engagement structure 24 is opened so that the first right side plate portion 15 and the second right side plate portion 16 can be opened again (similar to that shown by FIG. 4), the user can take the object inside the package box 3 from the right side of the package box 3. Furthermore, in the embodiment, the first right side plate portion 15 has a handle hole 152. The second right side plate portion 16 has a handle portion 162. When the first right side plate portion 15 and the second right side plate portion 16 are superimposed on each other, the handle portion 162 is aligned with the handle hole 152, the handle portion 162 can bend into the interior of the package box 3 to form a portion for the user to hold the package box 3 by hand.

In the embodiment, the left engagement structure 25 includes an engaging tab 252 and a slot structure 254. The engaging tab 252 is disposed at the place where the front plate portion 11 and the first left side plate portion 17 are connected. The slot structure 254 is disposed at another edge 18*b* of the second left side plate portion 18. When the first left side plate portion 17 and the second left side plate portion 18 are fixed with each other through the left engagement structure 25, the second left side plate portion 18 is located at the outer side of the first left side plate portion 17. In the embodiment, the left engagement structure 25 is also provided in the same structure as the top engagement structure 23 (or the right engagement structure 24). Therefore, for other descriptions of the left engagement structure 25, please refer to the relevant descriptions of the top engagement structure 23 and the variants thereof, which will not be described in addition. Similarly, after the left engagement structure 25 is opened so that the left right side plate portion 17 and the second left side plate portion 18 can be opened again (similar to that shown by FIG. 5), the user can take the object inside the package box 3 from the left side of the package box 3. Furthermore, in the embodiment, the first left side plate portion 17 has a handle hole 172. The second left side plate portion 18 has a handle portion 182. When the first left side plate portion 17 and the second left side plate portion 18 are superimposed on each other, the handle portion 182 is aligned with the handle hole 172, the handle portion 182 can bend into the interior of the package box 3 to form a portion for the user to hold the package box 3 by hand.

Figure 8:
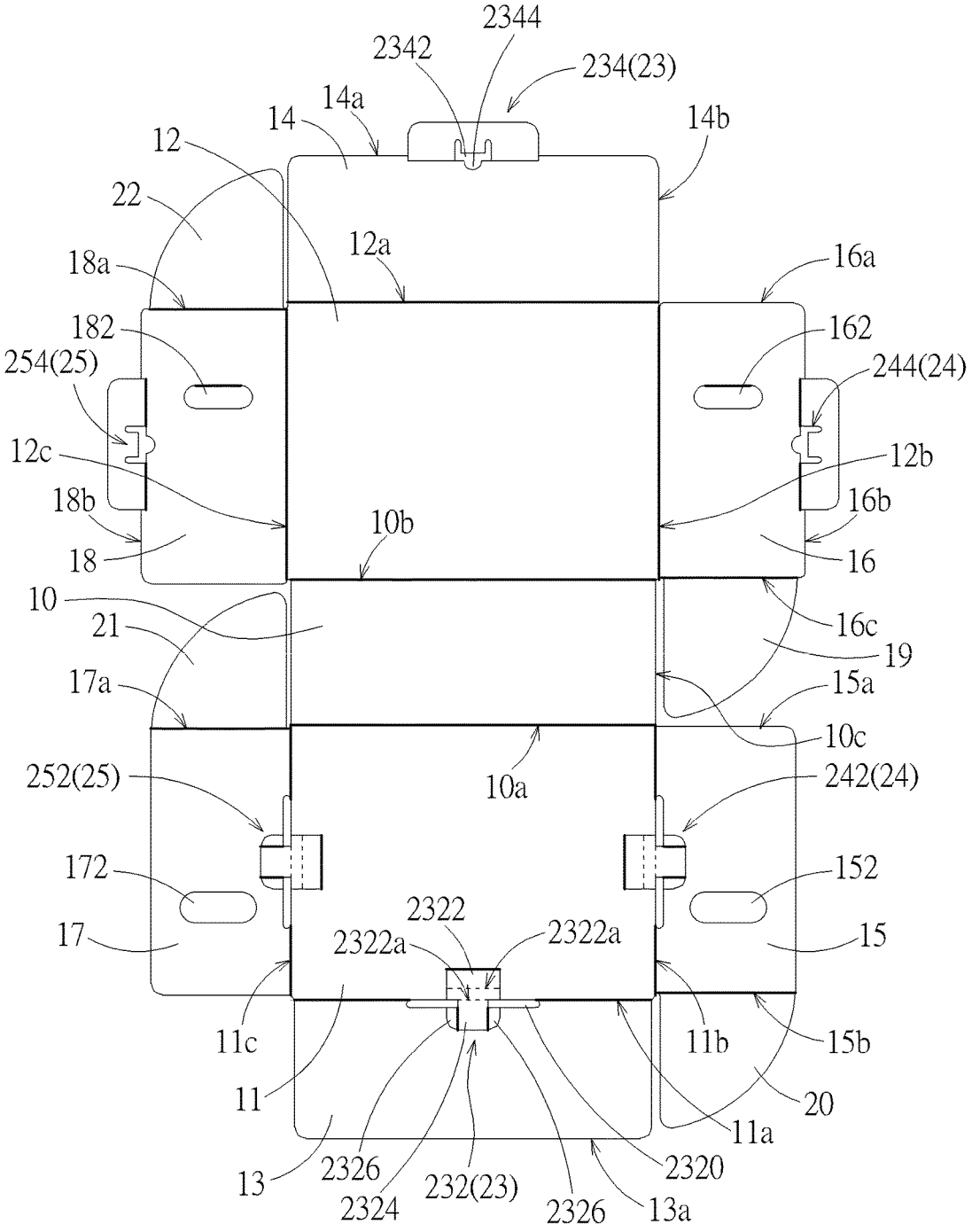
FIG. 8 is a schematic diagram illustrating a foldable sheet material of another embodiment.
Figure 9:
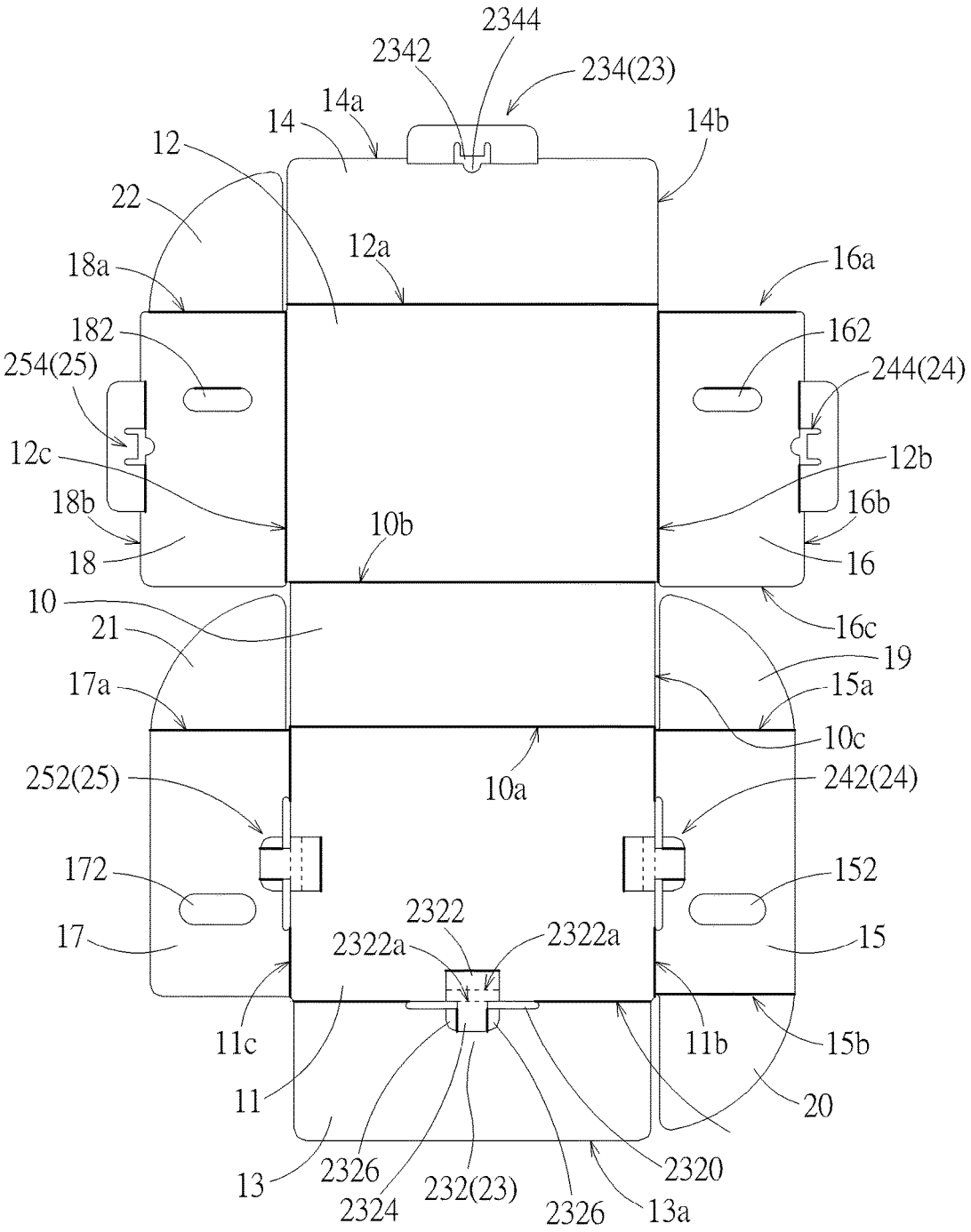
FIG. 9 is a schematic diagram illustrating a foldable sheet material of another embodiment.

In the embodiment, the top engagement structure 23, the right engagement structure 24, and the left engagement structure 25 are provided in the same structure but not limited thereto in practice. Furthermore, in the embodiment, the top engagement structure 23, the right engagement structure 24, and the left engagement structure 25 are located at the periphery of the front plate portion 11 but not limited thereto in practice. For example, the top engagement structure 23, the right engagement structure 24, and the left engagement structure 25 are distributed over the periphery of the front plate portion 11 and the periphery of the rear plate portion 12. Furthermore, in the embodiment, the right bottom plate portion 19 is a quarter circle plate and has two radius edge and an arc edge. The right bottom plate portion 19 is connected to the first right side plate portion 15 through one of the two radius edge; the other one of the two radius edges is toward another edge 10*c* of the bottom plate portion 10. The right top plate portion 20 is a quarter circle plate and has two radius edge and an arc edge. The right top plate portion 20 is connected to the second right side plate portion 16 through one of the two radius edge; the other one of the two radius edges is toward another edge 14*b* of the second top plate portion 14. However, the invention is not limited thereto. For example, the right bottom plate portion 19 and the right top plate portion 20 are provided in a triangular plate. Furthermore, the right bottom plate portion 19 and the right top plate portion 20 are connected to the first right side plate portion 15 and the second right side plate portion 16 respectively, but not limited thereto in practice. In practice, the right bottom plate portion 19 can be changed to be connected to another edge 16*c* of the second right side plate portion 16 while the right top plate portion 20 is connected to another edge 15*b* of the first right side plate portion 15, as shown by FIG. 8. Furthermore, in practice, the right bottom plate portion 19 and the right top plate portion 20 can be connected to the same plate (e.g. the two edges 15*a* and 15*b* of the first right side plate portion 15, as shown by FIG. 9). In addition, the above descriptions about the shape and disposition of the right bottom plate portion 19 and the right top plate portion 20 are also applicable to variations in the shape and disposition of the left bottom plate portion 21 and the left top plate portion 22, which will not be described in addition.

In the embodiment, the first top plate portion 13 and the second top plate portion 14 are provided in the same size, which is conducive to the structural strength of the top side of the package box 3. Similarly, the first right side plate portion 15 and the second right side plate portion 16 are provided in the same size. The first left side plate portion 17 and the second left side plate portion 18 are provided in the same size. The two structural designs are also conducive to the structural strength of the right side and the left side of the package box 3 respectively. However, the invention is not limited thereto.

In addition, in the embodiment, the foldable sheet material is provided with the top engagement structure 23, the right engagement structure 24, and the left engagement structure 25 directly formed thereon, so that on the whole, the package box 3 can form a firm box without glue. In practice, the foldable sheet material 1 also can be provided without the top engagement structure 23, the right engagement structure 24, and the left engagement structure 25. In this case, after the foldable sheet material 1 is folded into a package box, additional structures (e.g. string and button) are used on the package box for performing the function of the above engagement structures.

It is noticed that in practice, the package box 3 has six surfaces and is not limited to be placed on a plane in only one orientation (i.e. not limited to the embodiment in which the package box 3 is placed on the plane through the bottom plate portion 10). In the embodiment, the adjectives such as top, bottom, left, right, front and rear for the names of the components of the package box 3 or the foldable sheet material 1 are decided according to the orientation of the package box 3 in the embodiment just for the convenience of illustrating the package box 3, but not used to limit the practical disposition orientation of the package box 3.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A package box, comprising:

a bottom plate portion;

a front plate portion, connected to the bottom plate portion;

a rear plate portion, connected to the bottom plate portion opposite to the front plate portion;

a first top plate portion, connected to the front plate portion opposite to the bottom plate portion;

a second top plate portion, connected to the rear plate portion opposite to the bottom plate portion, the first top plate portion and the second top plate portion being superimposed on each other and detachably fixed with each other through a top engagement structure;

a first right side plate portion, connected to the front plate portion;

a second right side plate portion, connected to the rear plate portion corresponding to the first right side plate portion, the first right side plate portion and the second right side plate portion being superimposed on each other and detachably fixed with each other through a right engagement structure;

a first left side plate portion, connected to the front plate portion opposite to the first right side plate portion;

a second left side plate portion, connected to the rear plate portion corresponding to the first left side plate portion and opposite to the second right side plate portion, the first left side plate portion and the second left side plate portion being superimpose on each other and detachably fixed with each other through a left engagement structure;

a right bottom plate portion, connected to the first right side plate portion or the second right side plate portion and superimposed on the bottom plate portion;

a right top plate portion, connected to the first right side plate portion or the second right side plate portion opposite to the right bottom plate portion, the first top plate portion and the second top plate portion being superimposed on the right top plate portion;

a left bottom plate portion, connected to the first left side plate portion or the second left side plate portion and superimposed on the bottom plate portion; and a left top plate portion, connected to the first left side plate portion or the second left side plate portion opposite to the left bottom plate portion, the first top plate portion and the second top plate portion being superimposed on the left top plate portion.

2. The package box of claim 1, wherein the right bottom plate portion is a quarter circle plate and has two radius edges and an arc edge, the right bottom plate portion is connected to the first right side plate portion or the second right side plate portion through one of the two radius edges, and the right bottom plate portion abuts against the front plate portion or the rear plate portion through the other one of the two radius edges correspondingly.

3. The package box of claim 1, wherein the right top plate portion is a quarter circle plate and has two radius edges and an arc edge, the right top plate portion is connected to the first right side plate portion or the second right side plate portion through one of the two radius edges, and the right top plate portion abuts against the front plate portion or the rear plate portion through the other one of the two radius edges correspondingly.

4. The package box of claim 1, wherein the top engagement structure comprises an engaging tab and a slot structure, the engaging tab is disposed at a place where the first top plate portion and the front plate portion are connected, the slot structure is disposed at an edge of the second top plate portion, and the second top plate portion is located at an outer side of the first top plate portion.

5. The package box of claim 4, wherein the engaging tab comprises a connection portion, an insertion portion, and two wing portions, the engaging tab is connected through the connection portion to the place where the first top plate portion and the front plate portion are connected, the insertion portion is connected to the connection portion, the two wing portions are connected to two opposite edges of the insertion portion respectively, the slot structure has an n-shaped slot, and the two wing portions are capable of bending relative to the insertion portion so that the insertion portion and the two wing portions are capable of passing through the n-shaped slot.

6. The package box of claim 5, wherein the connection portion has two parallel tear lines extending to two opposite edges of the connection portion.

7. The package box of claim 4, wherein the right engagement structure comprises an engaging tab and a slot structure, the engaging tab of the right engagement structure is disposed at a place where the front plate portion and the first right side plate portion are connected, the slot structure of the right engagement structure is disposed at an edge of the second right side plate portion, and the second right side plate portion is located at an outer side of the first right side plate portion.

8. The package box of claim 1, wherein the top engagement structure, the right engagement structure, and the left engagement structure are located at a periphery of the front plate portion.

9. The package box of claim 1, wherein the first top plate portion and the second top plate portion have the same size.

10. The package box of claim 1, wherein the first right side plate portion and the second right side plate portion have the same size.

11. A foldable sheet material, capable of being folded to form a package box, the foldable sheet material comprising:

a bottom plate portion;

a front plate portion, extending from an edge of the bottom plate portion;

a rear plate portion, extending from another edge of the bottom plate portion opposite to the front plate portion;

a first top plate portion, extending from an edge of the front plate portion opposite to the bottom plate portion;

a second top plate portion, extending from an edge of the rear plate portion opposite to the bottom plate portion;

a first right side plate portion, extending from another edge of the front plate portion;

a second right side plate portion, extending from another edge of the rear plate portion corresponding to the first right side plate portion;

a first left side plate portion, extending from another edge of the front plate portion opposite to the first right side plate portion;

a second left side plate portion, extending from another edge of the rear plate portion corresponding to the first left side plate portion and opposite to the second right side plate portion;

a right bottom plate portion, extending from an edge of the first right side plate portion or an edge of the second right side plate portion and located between the first right side plate portion and the second right side plate portion;

a right top plate portion, extending from another edge of the first right side plate portion or another edge of the second right side plate portion opposite to the right bottom plate portion;

a left bottom plate portion, extending from an edge of the first left side plate portion or an edge of the second left side plate portion and located between the first left side plate portion and the second left side plate portion; and a left top plate portion, extending from another edge of the first left side plate portion or another edge of the second left side plate portion opposite to the left bottom plate portion.

12. The foldable sheet material of claim 11, wherein the right bottom plate portion is a quarter circle plate and has two radius edges and an arc edge, the right bottom plate portion is connected to the first right side plate portion or the second right side plate portion through one of the two radius edges, and the other one of the two radius edges is toward another edge of the bottom plate portion.

13. The foldable sheet material of claim 11, wherein the right top plate portion is a quarter circle plate and has two radius edges and an arc edge, the right top plate portion is connected to the first right side plate portion or the second right side plate portion through one of the two radius edges, and the other one of the two radius edges is toward an edge of the first top plate portion or an edge of the second top plate portion correspondingly.

14. The foldable sheet material of claim 11, further comprising an engaging tab and a slot structure matching with the engaging tab, wherein the engaging tab is disposed at a place where the first top plate portion and the front plate portion are connected, and the slot structure is disposed at an edge of the second top plate portion.

15. The foldable sheet material of claim 14, wherein the engaging tab comprises a connection portion, an insertion portion, and two wing portions, the engaging tab is connected through the connection portion to the place where the first top plate portion and the front plate portion are connected, the insertion portion is connected to the connection portion, the two wing portions are connected to two opposite edges of the insertion portion respectively, the slot structure has an n-shaped slot, and the two wing portions are capable of bending relative to the insertion portion so that the insertion portion and the two wing portions are capable of passing through the n-shaped slot.

16. The foldable sheet material of claim 15, wherein the connection portion has two parallel tear lines extending to two opposite edges of the connection portion.

17. The foldable sheet material of claim 11, wherein the first top plate portion and the second top plate portion have the same size.

18. The foldable sheet material of claim 11, wherein the first right side plate portion and the second right side plate portion have the same size.

* * * * *